US009174105B2

(12) United States Patent
Klein

(10) Patent No.: US 9,174,105 B2
(45) Date of Patent: Nov. 3, 2015

(54) GOLF TEE INSERTION TOOL

(71) Applicant: Lon Klein, Forest Hills, NY (US)

(72) Inventor: Lon Klein, Forest Hills, NY (US)

( * ) Notice: Subject to any disclaimer, the term of this patent is extended or adjusted under 35 U.S.C. 154(b) by 0 days.

(21) Appl. No.: 14/090,958

(22) Filed: Nov. 26, 2013

(65) Prior Publication Data

US 2014/0155196 A1 Jun. 5, 2014

Related U.S. Application Data

(60) Provisional application No. 61/729,888, filed on Nov. 26, 2012.

(51) Int. Cl.
*A63B 57/00* (2015.01)

(52) U.S. Cl.
CPC ..... *A63B 57/0037* (2013.01); *A63B 2209/00* (2013.01)

(58) Field of Classification Search
CPC ..... A63B 57/00; A63B 57/0018; A63B 57/0037; A63B 57/0068; A63B 2209/00; B25C 3/008; B25C 3/00
USPC ..... 473/386, 387–403, 408, 286; D21/718, D21/721, 793; 81/44
See application file for complete search history.

(56) References Cited

U.S. PATENT DOCUMENTS

| | | | | | |
|---|---|---|---|---|---|
| 534,143 | A | * | 2/1895 | Dowling | 81/44 |
| D25,308 | S | * | 3/1896 | Neff | D8/47 |
| D33,792 | S | * | 12/1900 | Adkins | D8/47 |
| 851,351 | A | * | 4/1907 | Hanley | 81/44 |
| 1,112,056 | A | * | 9/1914 | De Bow | 81/44 |
| 1,293,394 | A | * | 2/1919 | Fiori | 81/44 |
| D54,894 | S | * | 4/1920 | Carlson | D8/47 |
| 1,387,316 | A | * | 8/1921 | Schmidt | 81/44 |
| 1,440,072 | A | * | 12/1922 | Greener | 81/44 |
| 1,495,092 | A | * | 5/1924 | Makowski | 81/44 |
| 1,627,012 | A | * | 5/1927 | Copeland | 473/394 |
| 2,011,203 | A | * | 8/1935 | Seiki | 473/396 |
| 3,079,158 | A | * | 2/1963 | Finn et al. | 473/396 |
| 3,220,727 | A | * | 11/1965 | Legan | 473/386 |
| 3,633,919 | A | * | 1/1972 | Liccardello | 473/386 |
| 4,277,892 | A | * | 7/1981 | Rushforth | 473/386 |
| D368,943 | S | * | 4/1996 | Johnson | D21/793 |
| D398,359 | S | * | 9/1998 | Hicks | D21/796 |
| 5,820,490 | A | * | 10/1998 | Hronas et al. | 473/391 |
| 6,290,617 | B1 | * | 9/2001 | Cole et al. | 473/408 |
| 6,454,669 | B1 | * | 9/2002 | James | 473/400 |
| 7,008,335 | B2 | * | 3/2006 | Kim | 473/391 |
| 7,086,972 | B2 | * | 8/2006 | Bainbridge et al. | 473/386 |
| 2003/0195060 | A1 | * | 10/2003 | Wood | 473/386 |
| 2004/0162164 | A1 | * | 8/2004 | Rickard | 473/386 |
| 2007/0293353 | A1 | * | 12/2007 | Irwin | 473/386 |
| 2008/0132360 | A1 | * | 6/2008 | Shin | 473/386 |
| 2012/0028735 | A1 | * | 2/2012 | Klein | 473/398 |

* cited by examiner

*Primary Examiner* — Steven Wong
(74) *Attorney, Agent, or Firm* — Fay Kaplun & Marcin, LLP

(57) ABSTRACT

An insertion tool having a hub and a mandrel extending from the hub and including a tip that is configured to be inserted into a teeing ground to create a depression for insertion of a golf tee, wherein the mandrel is configured to receive a golf tee. The insertion tool may also have a second mandrel that is also configured to be inserted into the teeing ground to create a depression for insertion of a golf tee. The insertion tool may also include a further golf tool coupled to the hub.

12 Claims, 4 Drawing Sheets

GOLF TEE INSERTION TOOL

PRIORITY CLAIM/INCORPORATION BY REFERENCE

This application claims priority to U.S. Provisional Application Ser. No. 61/729,888 entitled "Tee Insertion Tool" that was filed on Nov. 26, 2012 and names Lon Klein as inventor. The entirety of that application is hereby expressly incorporated by reference into this application.

BACKGROUND

In golf, a tee is normally used (and is beneficial to use) for the first stroke of each hole, and the area from which this first stroke is hit is informally known as the tee box, also known as the teeing ground. Normally, teeing the ball is allowed only on the first shot of a hole, called the tee shot, and teeing up usually not allowed for any other shot. Teeing gives a considerable advantage for drive shots, so it is highly desirable whenever allowed. A standard golf tee is 2.750" (two and three quarter inches) long, but both longer and shorter tees are permitted and are preferred by some players.

A standard golf tee is constructed of wood, plastic or synthetic material and has a pointed end for insertion into the ground. However, there are also other types of tees such as the golf tee described in U.S. patent application Ser. No. 12/956,310 that may or may not include such a pointed end for insertion into the ground.

SUMMARY

An insertion tool, comprising a hub and a mandrel extending from the hub and including a tip that is configured to be inserted into a teeing ground to create a depression for insertion of a golf tee, wherein the mandrel is configured to receive a golf tee.

DETAILED DESCRIPTION

Figure 1:
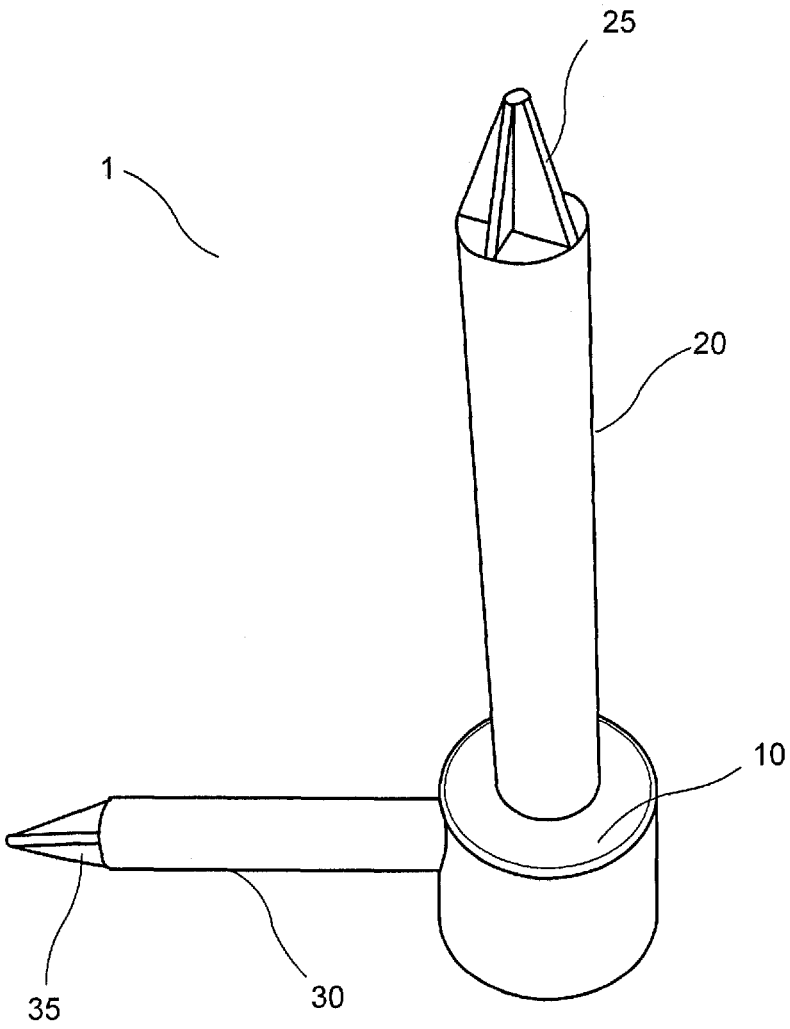
FIG. 1 shows an insertion tool for a golf tee according to an exemplary embodiment.

The exemplary embodiments may be further understood with reference to the following description and appended drawings, wherein like elements are referred to with the same reference numerals. The exemplary embodiments describe a golf tee insertion tool that prepares the teeing ground to receive a golf tee.

FIG. 1 shows an insertion tool 1 for a golf tee. The insertion tool 1 is designed, for example, for use with the golf tee described in U.S. patent application Ser. No. 12/956,310. The exemplary insertion tool 1 may be used to prepare the ground to receive this golf tee. However, it will be understood by those skilled in the art that the insertion tool 1 may be modified for use with any type of golf tees. The function of the insertion tool 1 may be generally described as preparing the teeing ground (e.g., the tee box) to receive the tee. The golf tee described in U.S. patent application Ser. No. 12/956,310 includes various components that are generally cylindrical hollow tubes. The hollow tubes are designed for direct insertion into the teeing ground. However, in some instances, the golfer may desire to prepare the teeing ground prior to inserting the tee into the ground. For example, the teeing ground may be harder than expected, the golfer may have weak fingers or hands making it difficult to push the tee into the teeing ground without first preparing the teeing ground, etc. The insertion tool 1 functions to prepare the teeing ground to receive the tee.

It is noted that the description includes various dimensions for the insertion tool 1. These dimensions are only meant to be exemplary and it is possible for an insertion tool 1 to be manufactured having different dimensions. In addition, the insertion tool 1 may be constructed from any rigid or semi-rigid material that will enable the insertion tool 1 to perform the function of preparing the ground as described herein. For example, the insertion tool 1 may be constructed from plastic, metal, composite material, a combination thereof, etc. The first described embodiment of the insertion tool 1 is described as having a unitary body. Thus, if the insertion tool 1 is constructed of plastic, the unitary body of the insertion tool 1 may be molded. In the example of the insertion tool 1 being constructed from metal, the unitary body may be stamped, milled and/or formed into the shape as described herein. However, as will be described in a further embodiment below, it is not a requirement that the insertion tool 1 have a unitary body.

The insertion tool 1 includes a generally cylindrical hub 10 that includes two (2) mandrels 20 and 30 extending from the hub 10. Those skilled in the art will understand that it is also possible to include only one (1) mandrel extending from the hub 10 or include more than two (2) mandrels extending from the hub 10. It is also noted that the hub 10 is not required to be cylindrical and may take any shape. The mandrels 20 and 30 also have a generally cylindrical shape that extends to a corresponding tip 25 and 35. The cylindrical diameter of the mandrels 20 and 30 are generally sized such that the tee may slide over the mandrel 20 and 30. Some examples of a golf tee being received by the mandrels 20 and 30 will be shown and described in greater detail below.

The mandrel 20 extends from a first end of the cylindrical hub 10 and the mandrel 30 extends from a side of the cylindrical hub 10. As described above, additional mandrels may extend from other positions of the cylindrical hub 10. For example, an additional mandrel may extend from a side of the cylindrical hub that is 180 degrees opposite the mandrel 30, 90 degrees offset from the mandrel 30 or any other angular offset from the mandrel 30 around the hub 10. In addition, it should be noted that other tools may be attached to the cylindrical hub 10 beside the mandrels 20 and 30. For example, the other tool may include a divot repair tool (having any shape such as a prong, a spade, etc), a golf spike wrench or any other tool commonly used by golfers. Similar to the additional mandrels, the other tools may be attached to the cylindrical hub 10 at any location, including, but not limited to 180 degrees opposite the mandrel 30.

As described above, the cylindrical hub 10 and the mandrels 20 and 30 may be constructed as a unitary body. However, it is also possible that the cylindrical hub 10 includes threaded holes or threaded extensions that may be used to attach the mandrels 20 and 30 or the other tools described above. Also, the connection between the mandrels 20 and 30 or the other tools and the cylindrical hub 10 is not limited to threaded connections, but may include any coupling mechanism that allows the mandrels 20 and 30 or the other tools to be permanently or detachably coupled to the cylindrical hub 10. When the mandrels 20 and 30 or the other tools are detachably connected to the cylindrical hub 10, this allows a user to change mandrels or tools as desired.

In the example of insertion tool 1, the mandrel 20 is longer than the mandrel 30. This is based on a configuration where the mandrel 20 is designed for use with longer tees (e.g., tees typically associated with drivers, 3 woods, etc.), and the mandrel 30 is designed for use with shorter tees (e.g., tees typically associated with irons, hybrids, etc.). In the example of insertion tool 1, the mandrel 20 may be 1.2-4.0 inches in length, excluding the tip 25. The mandrel 30 may be 0.5-2.5 inches in length, excluding the tip 35. The example maximum length of the mandrel is 4 inches based on the current USGA rule that allows a maximum length for a golf tee of 4 inches. However, the mandrel can be longer than the tee and therefore greater than 4 inches. Those of skill in the art will understand that the shape of the mandrels 20 and 30 and tips 25 and 35 may be varied to match the shape of the golf tee that is going to be inserted. For example, if instead of having a circular cross-section, the tee had an octagon shaped cross-section, the shape of the mandrels 20 and 30 and the tips 25 and 35 may also be designed with an octagon shaped cross-section.

The tips 25 and 35 are shown as tapering from the diameter of the body of the mandrel to a point. In this example, the tips 25 and 35 are a shown as including two flat triangular sections that intersect creating the appearance of a cone with four edges. However, the tips 25 and 35 may also take different shapes such as a solid cone, a screw or any other tip shape that can aid in preparing the ground to receive the tee that is on the mandrel. An exemplary length for the tips 25 and 35 is 0.25-0.0625 inches.

Figure 2:
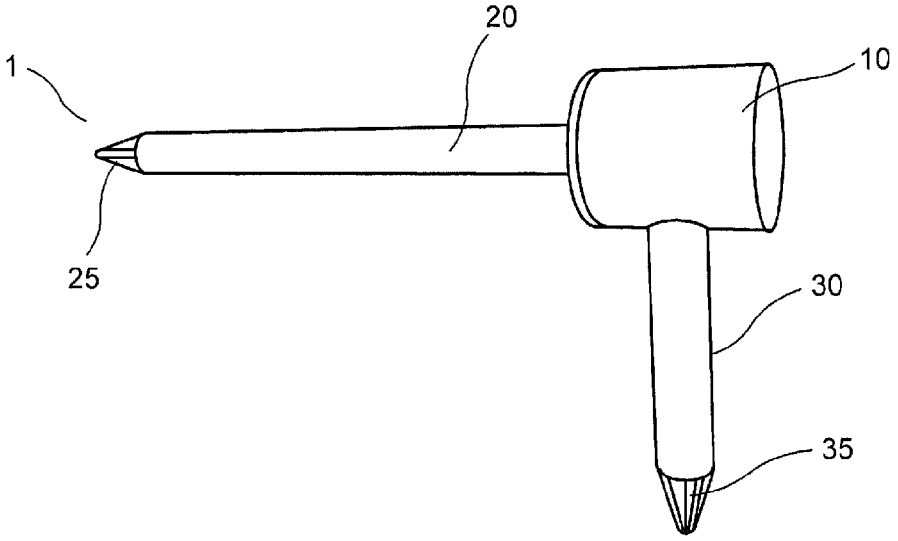
FIG. 2 shows a second view of an insertion tool for a golf tee according to an exemplary embodiment.

FIG. 2 shows a second view of the insertion tool 1 for a golf tee according to an exemplary embodiment. This second view also shows the cylindrical hub 10 having the mandrel 20 extending from an end of the cylindrical hub 10 to the tip 25. The mandrel 30 extends from the side of the cylindrical hub 10 to the tip 35.

Figure 3:
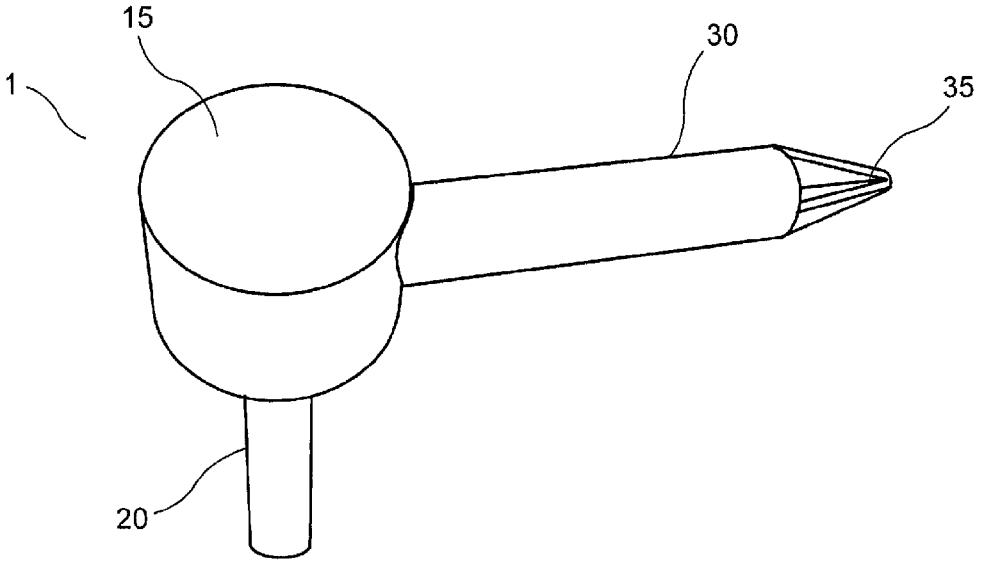
FIG. 3 shows a third view of the insertion tool for a golf tee according to an exemplary embodiment.

FIG. 3 shows a third view of the insertion tool 1 for a golf tee according to an exemplary embodiment. The view of insertion tool 1 in FIG. 3 shows the cylindrical hub 10, the mandrel 20, and the mandrel 30 and tip 35 as described above. However, the view of FIG. 3 also shows the end 15 of the cylindrical hub 10 that is opposite the end from which mandrel 20 extends. The end 15 of the cylindrical hub 10 includes an excavation or cup in which a golf ball may sit or the user may place their thumb when using the insertion tool 1 to prepare the ground for the tee. The use of the insertion tool 1 will be described in greater detail below.

Figure 4:
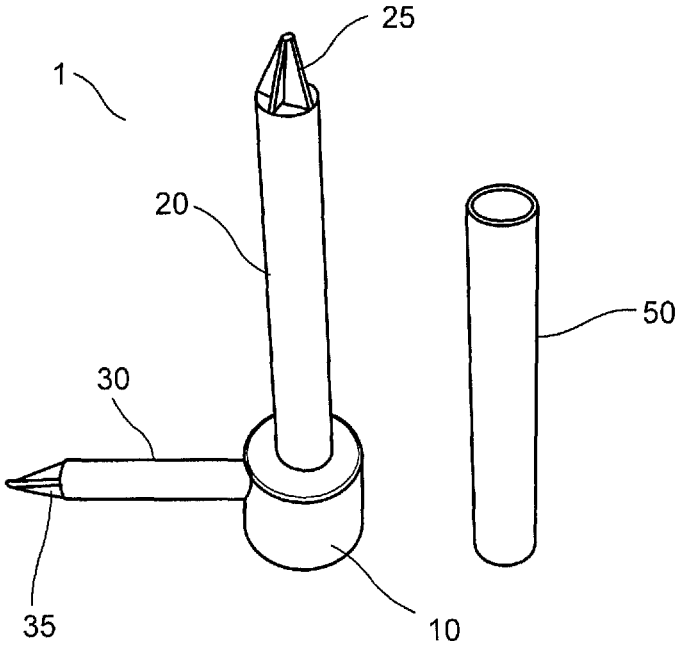
FIG. 4 shows an insertion tool and an exemplary golf tee to be used in conjunction with the insertion tool according to an exemplary embodiment.
Figure 5:
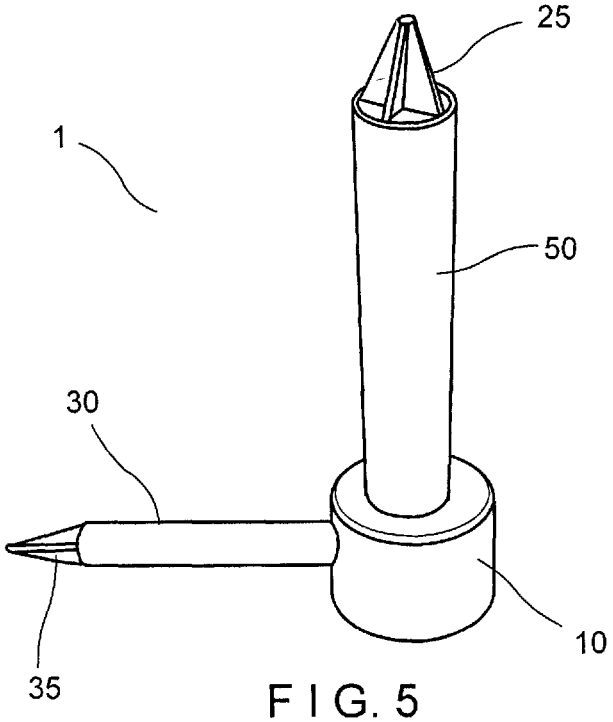
FIG. 5 shows the golf tee of FIG. 4 that is slid over a mandrel of the insertion tool according to an exemplary embodiment.

FIG. 4 shows the insertion tool 1 and an exemplary golf tee 50 to be used in conjunction with the insertion tool 1. The insertion tool 1 includes the cylindrical hub 10, the mandrel 20 and tip 25, and the mandrel 30 and tip 35 as described above. FIG. 4 also shows a tee 50 that comprises a cylindrical tube. In this example, the tee 50 is designed for use with the mandrel 20 and the tip 25. As described above, the diameter of the mandrel 20 is sized such that the tee 50 may slide over the mandrel 20. FIG. 5 shows the tee 50 that is slid over the mandrel 20. In this example, the tee 50 has a length that is substantially similar to the length of the body of the mandrel 20 such that the mandrel 20 is not visible in FIG. 5 because it is covered by the golf tee 50. However, the tip 25 is visible because the golf tee 50 does not extend over the tip 25. It is noted that the golf tee does not need to cover the entire body of the mandrel and it is also acceptable that the golf tee may extend to cover a portion of the tip 25.

The following will provide an example of the use of the insertion tool 1 in conjunction with the tee 50. A golfer may place the tee 50 onto the mandrel 20 of the insertion tool 1 as shown in FIG. 5. The golfer may then invert the insertion tool 1 such that the tip 25 is facing the teeing ground. As described above, the mandrel 20 is sized such that the tee 50 slides over the mandrel 20. The size may be such that when the tee 50 is slid over the mandrel 20, there is a small friction fit so the tee 50 does not slide off of the mandrel 20 when the insertion tool 1 is inverted as described above. In the alternative, the golfer may hold the tee 50 with for example the index and middle finger. As described above, when the insertion tool is inverted, the user may place a golf ball in the cup 15 of may simply choose to place their thumb into the cup 15. The golfer may place the tip 25 in contact with the teeing ground and then press down on the insertion tool 1 such that the tip 25 breaks the teeing ground such that the insertion tool 1 penetrates the teeing ground to the depth of the tip 25. As should be readily apparent, the tip 25 forms a hole or depression in the teeing ground having a diameter that is substantially equal to the tee 50. The golfer may then slide the tee 50 along the mandrel 20 away from the cylindrical hub 10 into the hole or depression created by the tip 25. The golfer may then pull the insertion tool 1 out of the ground leaving the tee 50 behind in the teeing ground being ready to receive a golf ball.

In an alternative use, the golfer may prepare the ground using the insertion tool 1 without placing the tee 50 over the mandrel 20. That is, the same procedure as described above may be performed by the golfer, except that the tee 50 is not placed over the mandrel 20. Once the ground is prepared by the tip 25 of the mandrel 20 and the insertion tool 1 is removed from the ground, the user may then separately place the tee 50 into the ground prepared by the insertion tool 1.

Figure 6:
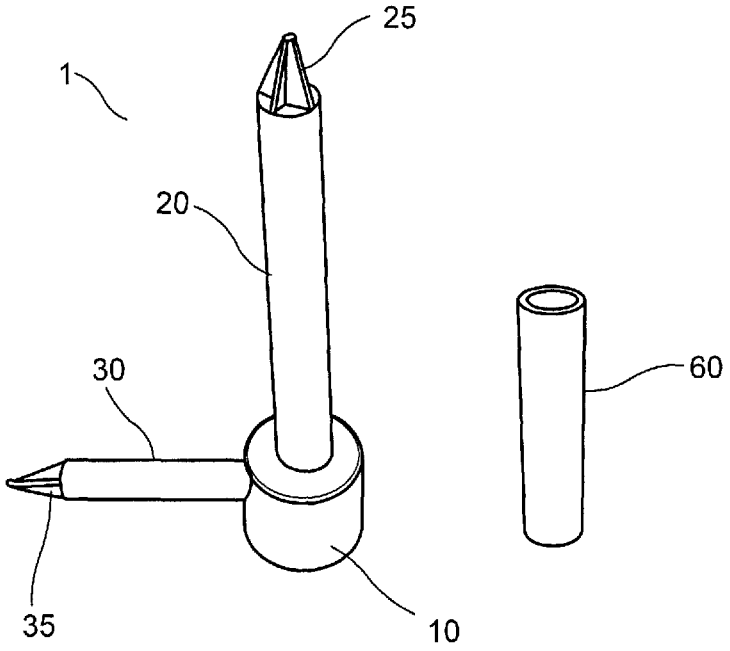
FIG. 6 shows an insertion tool and a second exemplary golf tee to be used in conjunction with the insertion tool according to an exemplary embodiment.
Figure 7:
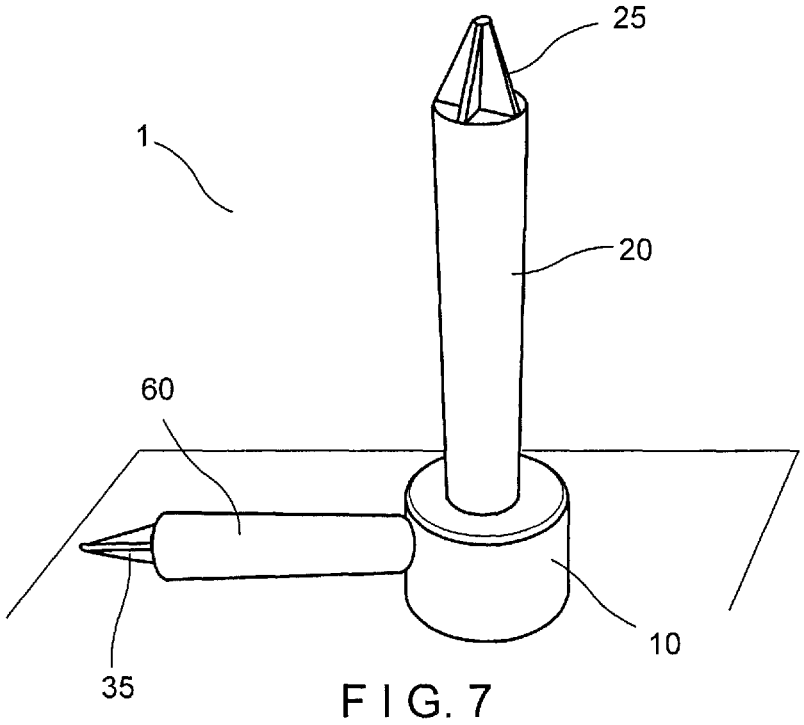
FIG. 7 shows the golf tee of FIG. 6 that is slid over a mandrel of the insertion tool according to an exemplary embodiment.

FIG. 6 shows the insertion tool 1 and an exemplary golf tee 60 to be used in conjunction with the insertion tool 1. The insertion tool 1 includes the cylindrical hub 10, the mandrel 20 and tip 25, and the mandrel 30 and tip 35 as described above. FIG. 4 also shows a tee 60 that comprises a cylindrical tube. In this example, the tee 60 is designed for use with the mandrel 30 and the tip 35. As described above, the diameter of the mandrel 30 is sized such that the tee 60 may slide over the mandrel 30. FIG. 7 shows the tee 60 that is slid over the mandrel 30. In this example, the tee 60 has a length that is substantially similar to the length of the body of the mandrel 30 such that the mandrel 30 is not visible in FIG. 7 because it is covered by the golf tee 60. However, the tip 35 is visible because the golf tee 60 does not extend over the tip 35. It is noted that the golf tee does not need to cover the entire body of the mandrel and it is also acceptable that the golf tee may extend to cover a portion of the tip 35.

It will be apparent to those skilled in the art that various modifications may be made in the present invention, without departing from the spirit or the scope of the invention. Thus, it is intended that the present invention cover modifications and variations of this invention provided they come within the scope of the appended claims and their equivalents.

What is claimed is:

1. An insertion tool, comprising:

a hub comprising a generally cylindrical body, wherein the hub includes a cup for receiving a golf ball;

a first mandrel extending from a side of the cylindrical body of the hub and including a tip that is configured to be inserted into a teeing ground to create a depression for insertion of a golf tee, wherein the first mandrel is configured to receive the golf tee; and a second mandrel extending from an end of the cylindrical body of the hub and including a tip that is configured to be inserted into the teeing ground to create a depression for insertion of the golf tee, wherein the second mandrel is configured to receive the golf tee.

2. The insertion tool of claim 1, wherein the hub, first mandrel and second mandrel comprise a unitary body.

3. The insertion tool of claim 1, wherein first mandrel and second mandrel are detachably coupled to the hub.

4. The insertion tool of claim 1, wherein the first mandrel and the second mandrel have different lengths.

5. The insertion tool of claim 1, wherein the first mandrel and second mandrel each has a shape that corresponds to the golf tee and is sized to receive the golf tee such that the golf tee slides over the first mandrel and second mandrel.

6. The insertion tool of claim 1, further comprising:

a golf tool coupled to the hub.

7. The insertion tool of claim 6, wherein the golf tool is one of a divot repair tool and a golf shoe spike wrench.

8. The insertion tool of claim 1, wherein a length of each of the first mandrel and second mandrel, excluding the tip, is between 0.5 and 4.0 inches.

9. The insertion tool of claim 1, wherein a length of the corresponding tip for each of the first mandrel and second mandrel is between 0.25 and 0.625 inches.

10. The insertion tool of claim 1, wherein the tip of each of the first mandrel and second mandrel comprises one of a conical shape, a solid conical shape and a screw shape.

11. The insertion tool of claim 1, wherein the insertion tool is constructed from one of a plastic, a metal, and a composite material.

12. The insertion tool of claim 1, wherein the cup is formed in an end of the generally cylindrical body of the hub.

* * * * *